US005497532A

United States Patent [19]

Glatz

[11] Patent Number: 5,497,532

[45] Date of Patent: Mar. 12, 1996

[54] VACUUM CLEANER NOZZLE

[75] Inventor: Dietmar Glatz, Olpe, Germany

[73] Assignee: Wessel-Werk GmbH & Co. KG, Reichshof, Germany

[21] Appl. No.: 190,339

[22] Filed: Feb. 1, 1994

[30] Foreign Application Priority Data

Feb. 16, 1993 [DE] Germany ..... 43 04 682.7

[51] Int. Cl.[6] ..... A47L 9/02; A47L 13/11

[52] U.S. Cl. ..... 15/401; 15/415.1

[58] Field of Search ..... 15/393, 396, 397, 15/398, 401, 415.1

[56] References Cited

U.S. PATENT DOCUMENTS

| | | | |
|---|---|---|---|
| 1,039,383 | 9/1912 | Goughnour | 15/415.1 |
| 1,110,439 | 9/1914 | Goughnour | 15/415.1 |
| 2,182,344 | 12/1939 | Lofgren | 15/398 |

FOREIGN PATENT DOCUMENTS

| | | | |
|---|---|---|---|
| 706716 | 3/1931 | France | 15/415.1 |
| 807813 | 1/1937 | France | 15/393 |
| 428619 | 5/1935 | United Kingdom | 15/393 |
| 597752 | 2/1948 | United Kingdom | 15/415.1 |

*Primary Examiner*—David Scherbel
*Assistant Examiner*—Terrence R. Till
*Attorney, Agent, or Firm*—Meltzer, Lippe, Goldstein

[57] ABSTRACT

The vacuum cleaner nozzle of the invention is provided with a nozzle body equipped with a suction pipe connecting piece and with a bottom plate which closes off the nozzle body towards the bottom, whereby at least one flow channel which is open towards the bottom and lets out into a central suction channel connected to the pipe connecting piece is located in the bottom plate. The flow channel is here double-parabolic in profile, meaning that it is parabolic in its cross section as well as in its longitudinal section extending perpendicularly to the bottom plate in relation to the longitudinal axis of the flow channel. The cross-section increases in this case from the bottom of the flow channel in the direction of the floor and from the end of the flow channel away from the suction channel in the direction of said suction channel. Thanks to this configuration of the suction channel, even distribution of the suction capacity is achieved over the entire width of the vacuum cleaner nozzle.

8 Claims, 2 Drawing Sheets

VACUUM CLEANER NOZZLE

BACKGROUND OF THE INVENTION

The present invention relates to a vacuum cleaner nozzle, more particularly, the present invention relates to improved airflow patterns for vacuum cleaner nozzles.

Vacuum cleaner nozzles of the type in question are provided with a flow channel letting out into a suction channel in the area of the bottom plate or of a so-called gliding plate functioning as a bottom plate for the precise guidance of the suction air flow produced by the sucking action of a vacuum cleaner motor. The suction channel is open at the bottom, i.e. towards the floor to be vacuumed as the vacuum cleaner nozzle is in operation. Normally several such flow channels are provided and extend symmetrically in relation to the central suction pipe towards the two axial ends of the nozzle.

In known vacuum cleaner nozzles of the type in question the flow channel or channels are made with a cross-section that is substantially constant over their entire length, with a more or less local widening of the cross-sections occurring only in the area of the outlet into the suction channel to ensure a frictionless transition into the suction channel without any significant resistance to the air flow. It is a main disadvantage in this design of the flow channels that the sucking action produced over the entire axial length of the flow channels, i.e. the negative pressure produced by the vacuum cleaner, is distributed unevenly. With this known configuration of the cross-section the sucking action decreases from the inside out, i.e. from the area of the suction channel outward, towards the axial ends of the flow channels, so that uniform suction and thereby cleaning action of the vacuum cleaner nozzle over its entire width or, relative to the longitudinal axis of the flow channels, over their entire length is not assured.

Based on this state of the art, it is the object of the instant invention to improve a vacuum cleaner nozzle of the type mentioned initially with respect to uniformity of its cleaning action over the entire nozzle width.

SUMMARY OF THE INVENTION

The invention is first of all based on the knowledge that the flowing speed of the suction air, and connected thereto the specific suction performance increases as the cross-section of the flow channels is reduced. However, this applies in this ideal form exclusively to a flow channel closed on all sides, i.e. which is open only in an axial direction. With a flow channel configuration such as in vacuum cleaner nozzles of the type discussed here, with a cross-section that is open towards the bottom, i.e. towards the floor to be vacuumed, the flow speed in the flow channel and in function thereof the vacuuming capacity is also determined by the aspired air entering over the longitudinal edges of the flow channels. Since the amount of air aspired over the edges of the flow channel is greatest near the suction channel and decreases as the distance from the suction pipe decreases, uniform flow and thereby cleaning capacity of the vacuum cleaner nozzle with respect to the axial length of the flow channels can only be achieved if the flow channels are designed so that the changes in flow channel cross-section which increase flow speed as the distance from the suction channel increases and the supply of air aspired over the longitudinal edges of the flow channels which decreases the flow speed in the flow channel cancel each other out at every point of the flow channel over its entire axial length. Tests have shown here that the best results are achieved if the flow channel is designed double-parabolically. "Double-parabolic" in the sense of the present invention means that the cross-section through the flow channel as well as the longitudinal section through the flow channel in relation to its longitudinal axis has a parabolic profile open towards the bottom, with the walls of the flow channel constituting the two parabola branches. The cross-sectional surface of the flow channel diminishes in this case, starting at the suction channel and pointing in the direction of the end away from the suction channel. The cross-section itself widens constantly from the bottom of the flow channel in direction of the floor to be vacuumed.

In a preferred embodiment of the invention the flow channel is not only parabolic in its longitudinal section oriented essentially perpendicular to the bottom plate, but is also parabolic in a longitudinal section which lies substantially within the plane of the bottom plate or is parallel to that plane. Similarly to the above described configuration, the cross section or the cross-sectional width increases from the end of the flow channel away from the suction channel towards the suction channel. In the last described longitudinal section the section width in the plane of the bottom plate or in the plane that is parallel to it is determined by the two parabola branches, similarly as in the cross-section.

Especially even distribution of vacuuming capacity over the entire axial length of the flow channel is achieved in a preferred embodiment of the invention in that the suction channel is placed in a known manner centrally in the axially central area of the vacuum cleaner nozzle, whereby at least two flow channels letting out into the suction channel extend in that case symmetrically in relation to the suction channel. The flow channels are here preferably oriented at a parallel to the front and/or rear edge of the nozzle body.

Additional influence and thereby control of the flow conditions in the flow channels and thereby of the vacuuming capacity of the vacuum cleaner nozzle can be achieved in another embodiment of the invention in that the flow channels are not closed off to the outside, as related to the longitudinal axis of the flow channels, but are at least partially open. The quantity of additional air flowing in and thereby the vacuuming capacity of the nozzle can be further influenced at least at the outermost ends of the flow channels in axial direction by the size of these openings.

In order to further improve the vacuuming capacity of the vacuum cleaner nozzle, provisions are made in another embodiment of the invention for the forward and rear edges of the flow channels, as related to a direction perpendicular to the longitudinal axis of the flow channels, to be designed at least some areas as suction or flow edges. These flow edges can be constituted by added beads protruding over the plane of the bottom plate. Preferably however, the flow edges are constituted in that the surface area of the bottom in front of the forward flow channel edge and/or the surface area behind the rear flow channel edge is at least slightly sloped up, away from the edges, so that the flow channel edge is given an at least slightly wedge-shaped profile without a bead being formed.

In order to limit the vacuuming action of the vacuum cleaner nozzle to a precisely defined surface area and thus to increase the specific vacuuming capacity per surface area provisions are made in another embodiment of the invention for the flow channel or the flow channels to be surrounded in at least some areas by sealing or closing elements at a distance. Thereby a particularly high degree of flow tightness and thereby of vacuuming action is achieved in the area between the flow channel edges and the sealing or closing elements. The sealing or closing elements can be made here in a known manner of a ring of bristles and/or a sealing lip, in particular a sealing lip made of an elastomer material.

The invention is explained in further detail below through drawings which merely show embodiment examples.

DETAILED DESCRIPTION OF THE PREFERRED EMBODIMENT

Figure 1:
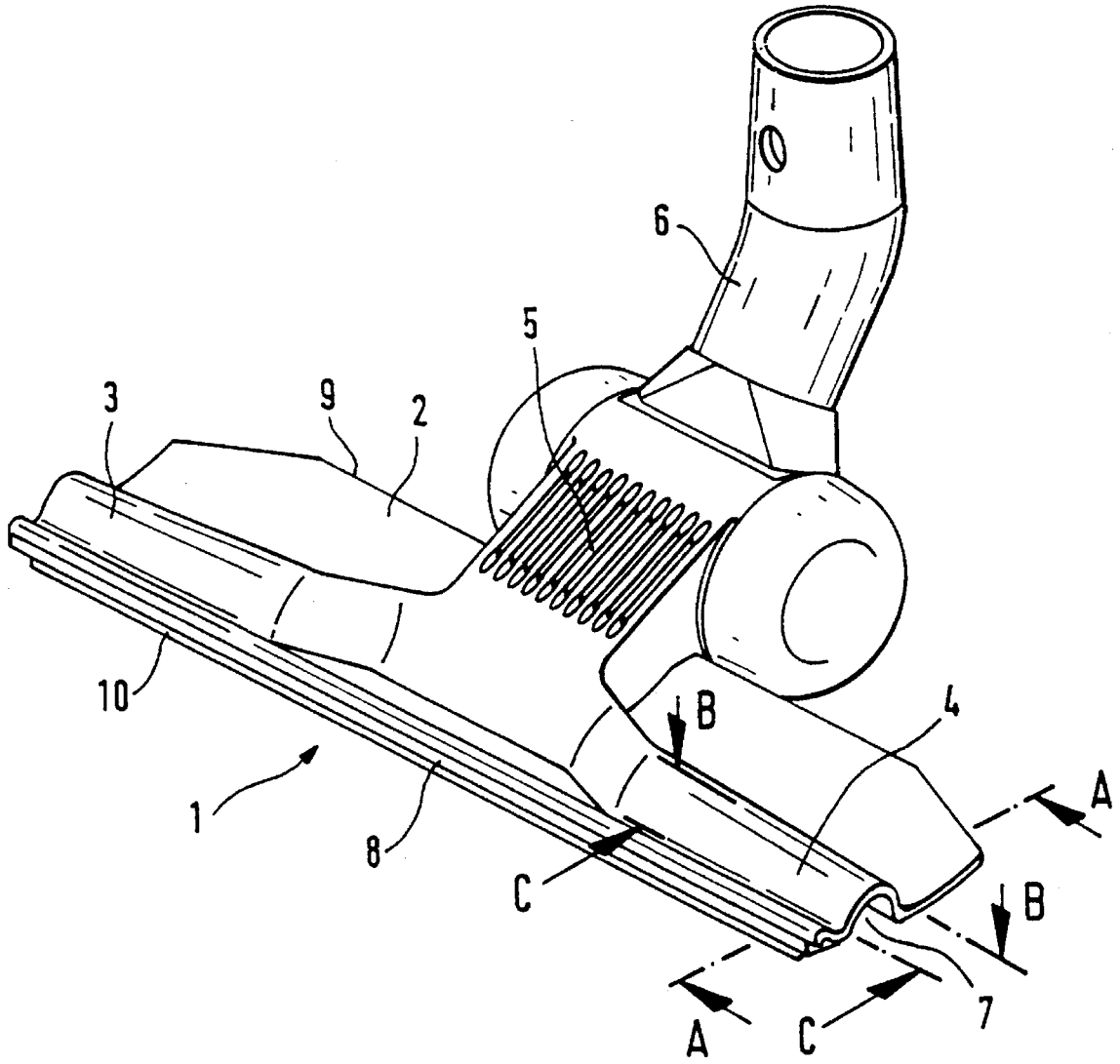
FIG. 1 is a perspective view of an embodiment of a vacuum cleaner nozzle according to the invention.

FIG. 1 shows a first embodiment of a vacuum cleaner nozzle according to the invention. The vacuum cleaner nozzle consists of a nozzle body 1 which is provided on its underside with a one-piece molded-on bottom plate 2 acting as a gliding plate. Towards the bottom, i.e. towards the floor to be vacuumed, open flow channels 3,4 are molded in form of grooves and these let out in axial direction into the central area of the nozzle, into a common suction channel 5. The suction channel can be connected via a suction pipe connecting piece 6, here in form of an articulated connection, to the suction pipe (not shown) of a vacuum cleaner in such manner as to allow air to flow through. The flow channels 3,4 are open in axial direction at their outer ends, i.e. at the ends 7 pointing away from the suction channel 5. The longitudinal axis of the flow channels 3 and 4 is substantially parallel to the forward edge 8 as well as to the rear edge 9 of the nozzle body 1 or the bottom plate 2.

In the area in front of the forward edge of the flow channels 3,4 as well as in the area behind the rear edge of the flow channels 3,4 a sealing lip 10 extending substantially over the entire axial length of the nozzle is provided, with the drawing of FIG. 1 merely showing the forward sealing lip schematically.

Figure 2:
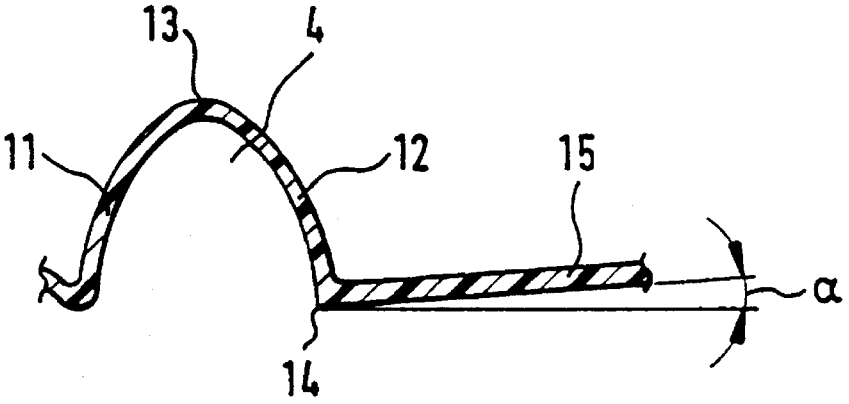
FIG. 2 is an out-of-scale schematic partial representation of a cross-section along line A—A through the flow channel of the embodiment of FIG. 1.
Figure 3:
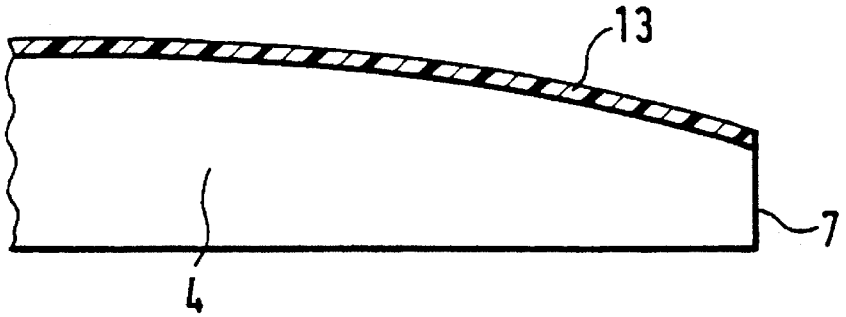
FIG. 3 is a partial out-of-scale representation of a vertical longitudinal section along line B—B through the flow channel of the embodiment of FIG. 1.
Figure 4:
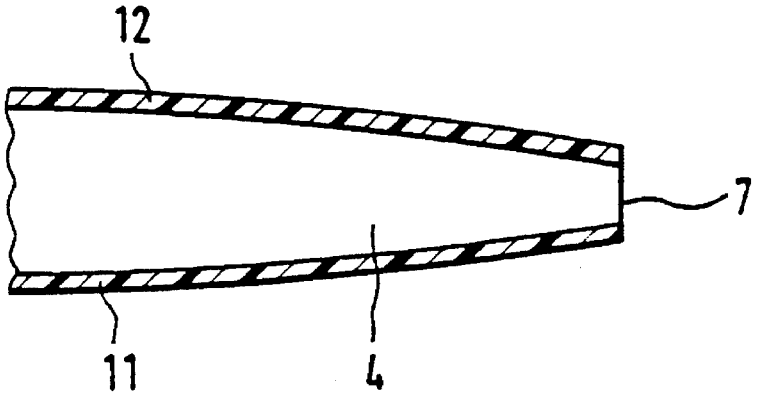
FIG. 4 shows a horizontal longitudinal section through he flow channel of the embodiment of FIG. 1 along line C—C in a partial schematic representation.

The profile of the flow channel 4 which is equal to the profile of the flow channel 3 is shown in FIGS. 2 to 4, whereby the cutting planes are the same as planes defining a rectangular coordinates system. FIG. 2 shows a cross-section through the flow channel 4 along a line A—A. This cross-section shows a parabola-shaped profile with the two parabola branches 11 and 12 and the crest 13. The parabola opens towards the bottom, i.e. towards the floor to be vacuumed.

FIG. 3 shows a longitudinal section through the flow channel 4 along line B—B which coincides substantially with the crest line 13 of FIG. 2. From this drawing it can be seen that the height of the cross-section, which is basically the same as the depth of the flow channel 4, narrows from the inside, along the axis, i.e. from the suction channel 5 which is not shown in axial direction to the outside, to the outer end 7 along the axis, whereby the course of the crest line 13 and with it of the bottom of the flow channel 4, is parabolic. By contrast to the cross-section of FIG. 2, the section of FIG. 3 is however limited only on one side by one single parabola branch 13, since the flow channel 4 is open towards the bottom.

FIG. 4 shows a longitudinal section through the flow channel 4 along cutting section C—C. The cutting plane in this case is substantially equal to the plane of bottom plate 2 or of a horizontal plane parallel to the latter. In this drawing the two wall areas 11 and 12 ar cut along the parabola branches of the drawing in FIG. 2. Here the two wall areas 11 and 12 each of which represents one branch of a parabola form a cross-sectional profile which narrows parabolically from the suction channel which is not shown towards the outer end 7 of the flow channel 4 along its axis.

It can furthermore be seen from the drawing of FIG. 2 that the area 15 of the bottom plate located behind the rear edge 14 of the flow channel 4 is inclined slightly upward at an angle $\alpha$ in relation to the horizontal, so that the flow channel edge 14 is given a wedge-shaped flow profile.

I claim:

1. Vacuum cleaner nozzle comprising:

a nozzle body, said nozzle body having:

at least one edge, a bottom side, a nozzle, said nozzle having a nozzle bottom, a suction pipe connecting piece to connect a suction pipe to said nozzle body, and a bottom plate, said bottom plate closing off said nozzle bottom towards said bottom side, said bottom plate having at least one flow channel, said flow channel having a bottom directed and opening toward a floor to be cleaned, said flow channel further having a longitudinal axis and a longitudinal cross section, said flow channel further having a second cross section perpendicular to said longitudinal axis, said flow channel further open towards said bottom side, said flow channel leading into a common suction channel connected to said suction pipe connecting piece, said flow channel further having an end on said longitudinal axis away from said suction channel, wherein at least two of said flow channels are placed symmetrically in relation to said suction channel, said flow channels further being substantially parallel to said edge of said nozzle body, said second cross section of said flow channels further being parabolic in shape whereby said second cross-section increases toward said suction channel from said end, said longitudinal cross section of said flow channels being parabolic in shape, said longitudinal cross section extending substantially at a perpendicular to said bottom plate along said longitudinal axis of said flow channels whereby said longitudinal cross-section increases from said bottom of said flow channel towards the floor and from said end of said flow channel towards said suction channel.

2. Vacuum cleaner nozzle as in claim 1, wherein said flow channels are parabolic also in a longitudinal section parallel to a plane along said bottom plate, whereby the cross-section increases from said end of said flow channel toward the direction of said suction channel.

3. Vacuum cleaner nozzle as in claim 1, characterized in that said suction channel is located centrally on said nozzle body.

4. Vacuum cleaner nozzle as in claim 1, wherein said flow channels are open in an axial direction.

5. Vacuum cleaner nozzle as in claim 1, wherein said flow channels further have a forward edge and a rear edge each of which is located on a different side of said longitudinal axis, at least one of said edges is made at least in part as a flow edge to form a forward flow channel edge and a rear flow channel edge.

6. Vacuum cleaner nozzle as in claim 5, said flow edge are formed such that a surface area in front of at least one of said flow channel edges is inclined at least slightly in relation to a plane along said bottom plate so that said flow channel edge is given a wedge-shaped profile.

7. Vacuum cleaner nozzle as in claim 1, wherein at least one of said flow channels has a sealing element surrounding at least part of said flow channel.

8. Vacuum cleaner nozzle as in claim 7, wherein said sealing element is a sealing lip, said sealing lip is made of an elastomer material.

* * * * *